US008544606B2

(12) United States Patent
Covino

(10) Patent No.: US 8,544,606 B2
(45) Date of Patent: Oct. 1, 2013

(54) OIL DRAINAGE APPARATUS

(76) Inventor: Daniel J. Covino, Norwich, CT (US)

( * ) Notice: Subject to any disclaimer, the term of this patent is extended or adjusted under 35 U.S.C. 154(b) by 216 days.

(21) Appl. No.: 13/111,045

(22) Filed: May 19, 2011

(65) Prior Publication Data

US 2011/0284786 A1 Nov. 24, 2011

Related U.S. Application Data

(60) Provisional application No. 61/346,549, filed on May 20, 2010.

(51) Int. Cl.
*F16C 3/14* (2006.01)
*F16N 33/00* (2006.01)

(52) U.S. Cl.
USPC ..... 184/1.5

(58) Field of Classification Search
USPC ..... 184/1.5
See application file for complete search history.

(56) References Cited

U.S. PATENT DOCUMENTS 1,995,174 A * 3/1935 Gerrard et al. ..... 251/83
2,187,247 A * 1/1940 Russell ..... 251/144
2,245,887 A * 6/1941 Wikander ..... 4/295
2,704,156 A * 3/1955 Botstiber ..... 210/222
3,097,663 A * 7/1963 Buchwald ..... 137/351
3,477,459 A * 11/1969 Schossow ..... 137/351
3,812,810 A * 5/1974 Moeller ..... 114/197
3,871,483 A * 3/1975 Espinosa et al. ..... 184/1.5
4,150,809 A * 4/1979 Muller ..... 251/149.4
4,231,544 A * 11/1980 Balch ..... 251/144
4,298,182 A * 11/1981 Balch ..... 251/251
4,361,310 A * 11/1982 Cummins ..... 251/144
4,449,613 A * 5/1984 Price ..... 184/1.5
4,470,577 A * 9/1984 Warwick ..... 251/217
4,676,206 A * 6/1987 DeGrazia, Jr. ..... 123/196 S
4,709,722 A * 12/1987 Knapp ..... 137/539
4,905,643 A * 3/1990 DeGrazia, Jr. ..... 123/196 S
4,907,676 A * 3/1990 Shirdavani ..... 184/1.5
4,917,356 A * 4/1990 Shirdavani ..... 251/294
5,086,522 A * 2/1992 Stofko, Sr. ..... 4/295
5,329,971 A * 7/1994 Condon ..... 138/89
D373,623 S * 9/1996 Mathison ..... D23/260
5,579,815 A * 12/1996 Labonte ..... 141/384
5,588,502 A * 12/1996 Bedi et al. ..... 184/1.5
5,667,195 A * 9/1997 McCormick ..... 251/149.6
5,680,970 A * 10/1997 Smith et al. ..... 222/514
5,908,086 A * 6/1999 Conklin et al. ..... 184/1.5
6,053,288 A * 4/2000 Okpokowuruk ..... 188/67
6,234,274 B1 * 5/2001 van der Griendt ..... 184/105.3
6,314,989 B1 * 11/2001 Fritz et al. ..... 137/449
6,318,500 B1 * 11/2001 Mizani ..... 184/1.5
6,902,038 B2 * 6/2005 Takahara ..... 184/1.5

(Continued)

*Primary Examiner* — William A Rivera
*Assistant Examiner* — Henry Liu
(74) *Attorney, Agent, or Firm* — Dale J. Ream

(57) ABSTRACT

An oil drainage apparatus includes a disk-shaped base member having an outer tube extending upwardly and defining a channel. The outer tube has a threaded exterior surface for coupling to a threaded engine oil pan drainage port. An inner tube is positioned in the channel and outer tube and is movable between a retracted configuration in which a closed inner tube upper end in is sealed in the outer tube and an extended configuration in which the closed upper end extends above the channel open upper end. The inner tube defines at least one aperture configured to receive oil from the oil pan into the inner tube when the inner tube is at the extended configuration and to direct oil through the channel lower end.

14 Claims, 7 Drawing Sheets

(56) References Cited

U.S. PATENT DOCUMENTS

| | | | | |
|---|---|---|---|---|
| 7,134,641 | B2 * | 11/2006 | Jensen et al. | 251/149.8 |
| 7,168,683 | B2 * | 1/2007 | Pliml, Jr. | 251/353 |
| 7,191,722 | B1 * | 3/2007 | Plost | 114/197 |
| 8,201,578 | B2 * | 6/2012 | Suzuki et al. | 137/590 |
| 8,235,759 | B1 * | 8/2012 | Belter et al. | 440/88 C |
| 2003/0070876 | A1 * | 4/2003 | Takahara | 184/1.5 |
| 2003/0089419 | A1 * | 5/2003 | Few | 141/65 |
| 2005/0098384 | A1 * | 5/2005 | Chang | 184/1.5 |
| 2007/0209876 | A1 * | 9/2007 | Sato | 184/1.5 |
| 2009/0057058 | A1 * | 3/2009 | Meyers | 184/1.5 |
| 2011/0100756 | A1 * | 5/2011 | Peng | 184/1.5 |

* cited by examiner

OIL DRAINAGE APPARATUS

REFERENCE TO RELATED APPLICATIONS

This application is a non-provisional patent application claiming the benefit of a provisional application Ser. No. 61/346,549 filed on May 20, 2010 entitled The Dragonfly Oil Drain system.

BACKGROUND OF THE INVENTION

This invention relates generally to automotive accessories and, more particularly, to an oil drainage apparatus configured to be mounted to an oil pan drainage outlet of an automobile engine.

Changing the oil in an automobile is a common practice by vehicle owners and one that is advisable and necessary in order to maintain good engine operation. The task of changing oil, however, is one that is frequently delegated to car dealership mechanics or auto repair shops in that the usual oil changing process is dirty, inconvenient, and will result in future leakage if not carried out competently. The oil changing process requires the automobile to be either jacked up or for the person changing the oil to slide underneath the car. An oil pan drainage plug is accessible from underneath the car and must be removed in order to drain the oil from the oil pan. Removing the plug may result in the mechanic's fingers becoming oily or in oil being released before a collection container can be moved into place, resulting in a mess on the mechanics hands or, worse yet, all over the floor.

Various oil plugs have been proposed to simplify the process of changing an engine's oil. Although assumably effective, the existing products are either not permanently mounted to an oil pan, are not convenient to mount or use, or do not result in an efficient means for changing and engine's oil.

Therefore, it would be desirable to have an oil drainage apparatus that replaces a traditional engine threaded bolt oil pan plug and which selectively drains oil from the oil pan merely by operating a lever. Further, it would be desirable to have an oil drainage apparatus that includes a spring-biased lever that causes oil to drain when depressed and that automatically returns to a sealed configuration when released. In addition, it would be desirable to have an oil drainage apparatus having an inner tube that defines apertures for selectively receiving oil from an engine oil pan and directing it through an outlet port.

SUMMARY OF THE INVENTION

An oil drainage apparatus according to the present invention includes a disk-shaped base member having an outer tube extending upwardly and defining a channel. The outer tube has a threaded exterior surface for coupling to a threaded engine oil pan drainage port. An inner tube is positioned in the channel and outer tube and is movable between a retracted configuration in which a closed inner tube upper end in is sealed in the outer tube and an extended configuration in which the closed upper end extends above the channel open upper end. The inner tube defines at least one aperture configured to receive oil from the oil pan into the inner tube when the inner tube is at the extended configuration and to direct oil through the channel lower end.

Therefore, a general object of this invention is to provide an oil pan drainage apparatus that permanently replaces a conventional oil pan drainage plug and which causes the oil pan to drain at the single push of a button or lever.

Another object of this invention is to provide an oil pan drainage apparatus, as aforesaid, that includes a lever that is pivotally movable to push an inner tube up into the oil pan to direct and drain oil downward through an internal channel.

Still another object of this invention is to provide an oil pan drainage apparatus, as aforesaid, that is easy to install and easy to use.

Yet another object of this invention is to provide an oil pan drainage apparatus, as aforesaid, that is economical to manufacture.

A further object of this invention is to provide an oil pan drainage apparatus, as aforesaid, that includes structural and gasket seals to prevent leakage.

A still further object of this invention is to provide an oil pan drainage apparatus, as aforesaid, that has a low profile configuration so as to minimize the chance of being damaged by objects passing underneath a vehicle while driving.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
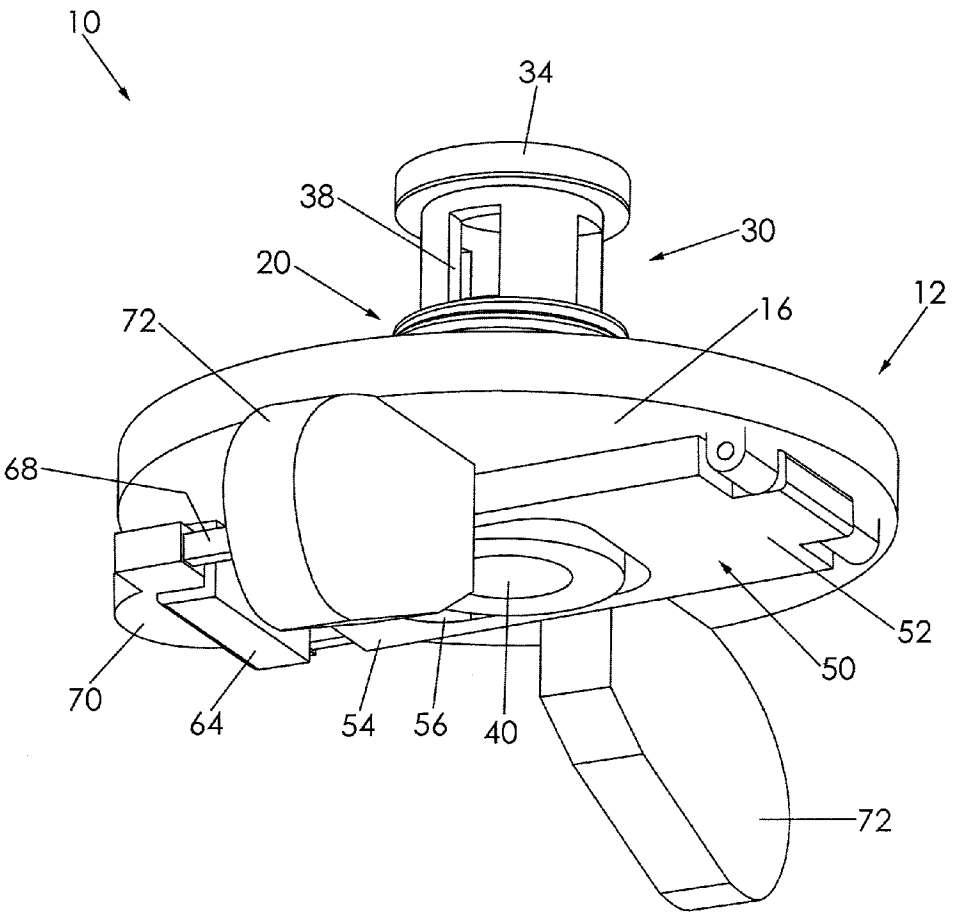
FIG. 1 is a perspective view from a bottom side angle of an oil pan drainage apparatus according to a preferred embodiment of the present invention, the apparatus being shown with an actuation lever in an actuated or depressed configuration.

An oil pan drainage apparatus according to a preferred embodiment of the invention will now be described in detail with reference to FIGS. 1 to 7 of the accompanying drawings. The oil pan drainage apparatus 10 includes a base member 12, an outer tube 20, an inner tube 30, and an actuation lever 50.

The base member 12 includes a top surface 14, an opposed bottom surface 16 arranged in a generally circular or disk shaped configuration with a thin streamlined profile although other configurations would also be suitable. The base member 12 defines a channel 18 extending between top 14 and bottom 16 surfaces. Described another way, the channel 18 is a bore through the center of the base member 12 through which oil will flow as described more fully below.

Figure 3B:
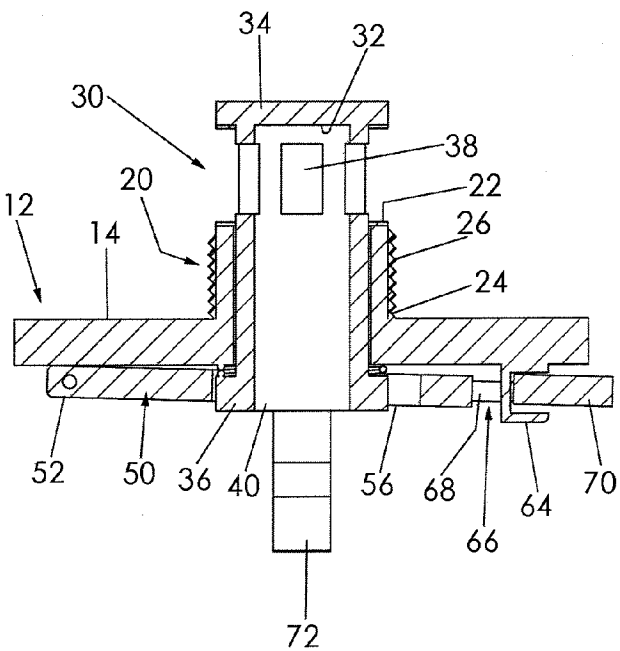
FIG. 3*b* is a sectional view taken along line 3*b*-3*b* of FIG. 3*a;*
Figure 3A:
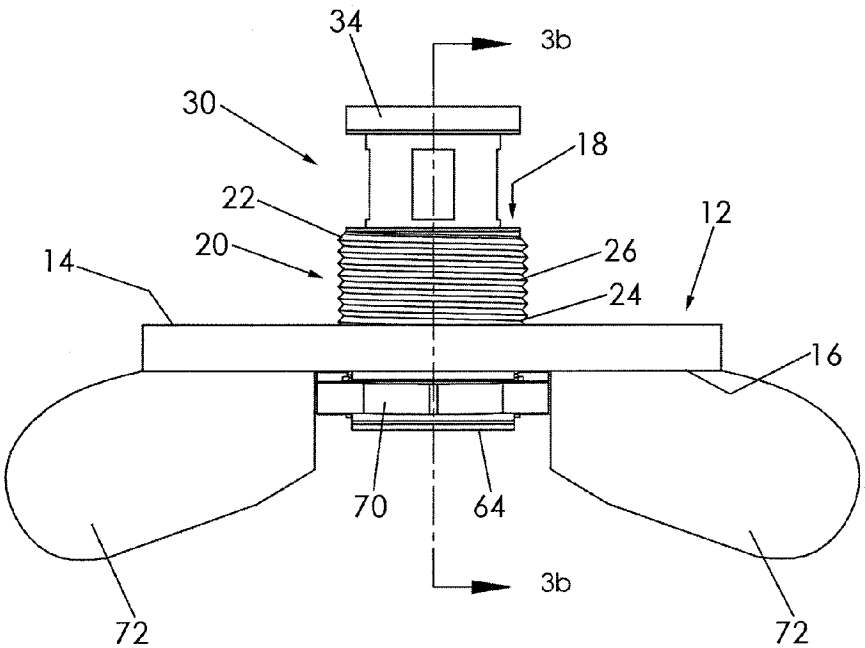
FIG. 3*a* is a side view of the apparatus as in FIG. 1.

The outer tube 20 is a tubular flange that extends upwardly from the top surface 14 of the base member 12. An inner diameter of the outer tube 20 is aligned with the channel 18 extending through the base member 12 such that the channel 18 in essence extends through the outer tube 20 as well as the base member 12. The outer tube 20 may have a unitary construction with the base member 12 and may have a singular construction as shown in FIG. 3*b*. The outer tube 20, and therefore the channel 18, defines an open upper end 22 and lower end 24. The outer tube 20 includes an exterior surface 26 having a threaded configuration that is complementary to an internal threaded configuration of an oil pan drainage port (not shown) so as to be selectively and removably coupled thereto in the manner of an oil pan plug.

Figure 4B:
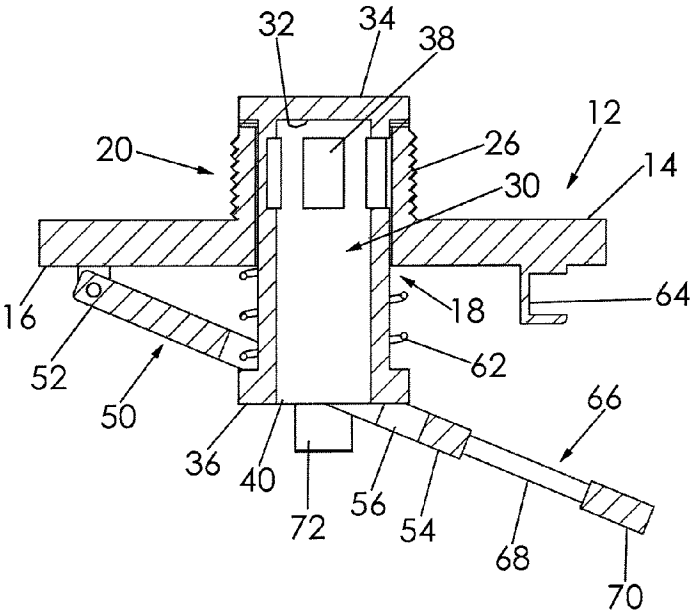
FIG. 4*b* is a sectional view taken along line 4*b*-4*b* of FIG. 4*a;*
Figure 4A:
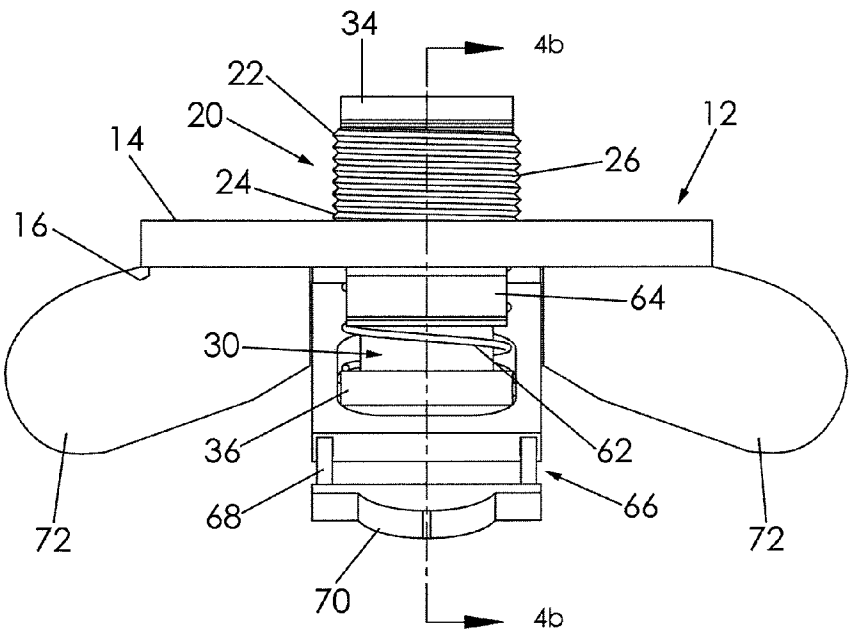
FIG. 4*a* is a side view of the apparatus as in FIG. 2.

The inner tube 30 includes a generally tubular configuration situated within the outer tube 20 and channel 18 and is movable therein between retracted (FIG. 4*a*) and extended (FIG. 3*a*) configurations. The inner tube 30 may include a closed upper end 32, which may be embodied as an upper rim 34 configured to seal with the upper end of the outer tube 20 when in the retracted configuration (FIG. 4*b*). The inner tube 30 preferably includes a lower rim 36 extending outwardly adjacent the inner tube open bottom end 40. The lower rim 36 is configured as a stop bearing against the base member bottom surface 16 when the inner tube 30 is being moved from the retracted configuration to the extended configuration (FIG. 3*b*). As shown, a gasket 42, 44 or other sealing component may be situated to the interior of each rim 34, 36 respectively, to prevent leakage, as will be described more fully below. The inner tube 30 defines at least one aperture 38 in its side wall adjacent the closed end 32, each aperture 38 being configured to receive oil from the oil pan into the inner tube 30 such that oil received therein is drained out through the inner tube open lower end 40. Preferably, the inner tube 30 defines a plurality of apertures 38 so as to drain an oil pan more quickly. It is understood that the one or more apertures 38 may actually be defined by the inner tube upper end 32 itself. Although use of the apparatus 10 will be described more fully later, it should be apparent that at the retracted configuration (FIGS. 3*a* and 3*b*), oil in an engine oil pan is prevented from flowing into the inner tube 30 while oil is allowed to flow therein when the inner tube 30 is at the extended configuration and the apertures 38 are extended above the outer tube 20 and into the oil pan (FIGS. 4*a* and 4*b*).

Figure 2:
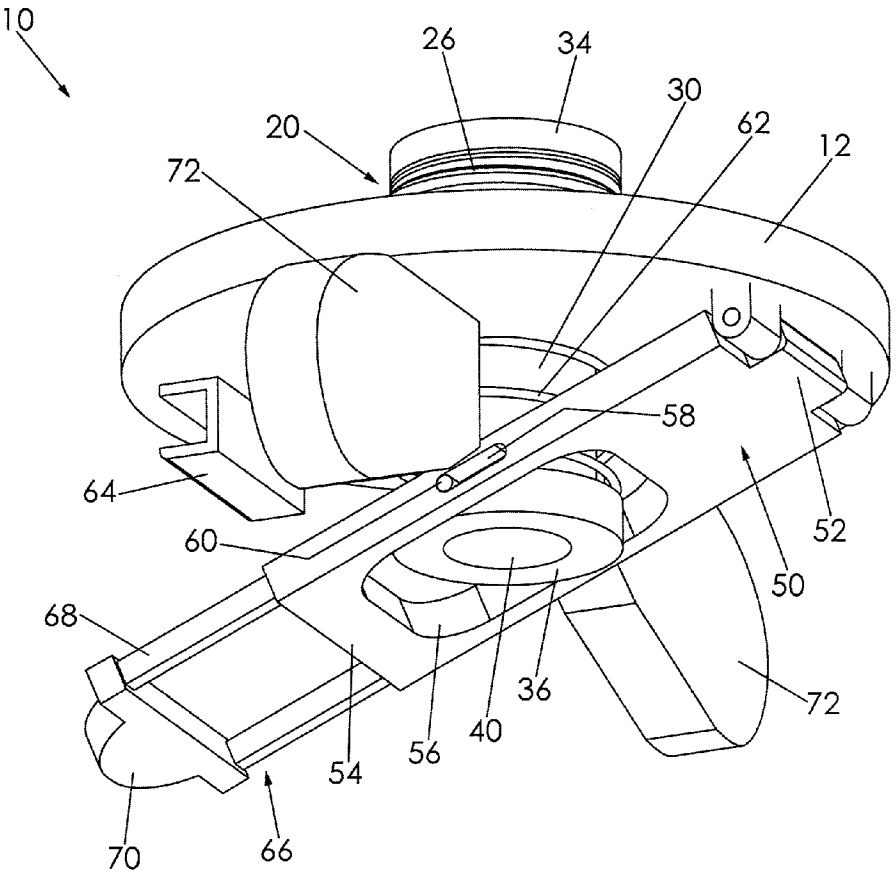
FIG. 2 is another perspective view of the apparatus as in FIG. 1 with the lever in a released or unactuated configuration.

As particularly shown in FIG. 2, the lever 50 is mounted to the bottom surface 16 of the base member 12 and operatively coupled to the inner tube 30 such that operation of the lever 50 causes the inner tube 30 to move to the extended configuration. More particularly, the lever 50 includes a first end 52 pivotally coupled to the body member bottom surface 16 adjacent a peripheral edge thereof. The lever 50 includes a lever second end 54 opposed from the first end 52 and defines an opening 56 intermediate the first 52 and second 54 ends. The lever opening 56 is situated such that the inner tube lower rim 36 is received substantially therein. In addition, the lever 50 defines at least one slot 58 adjacent the opening 56. The inner tube 30 may be coupled to the lever 50 with a pin 60 that extends outwardly from the inner tube lower rim 36 and registers with the slot 58. When the lever 50 is depressed, the inner tube 30 is pushed upwardly in the channel 18 of the outer tube 20 (by the connection of the pin 60 to the inner tube lower rim 36), the slot 58 having a length to slidably receive the pin 60 as the lever 50 is depressed.

Figure 5:
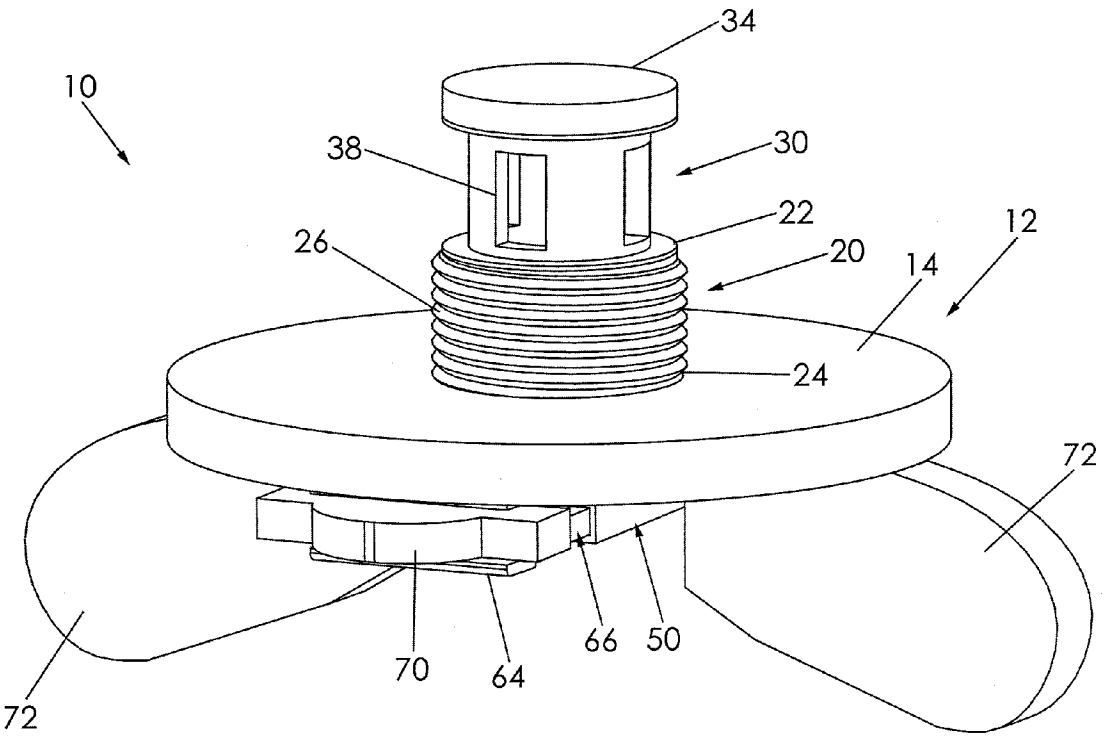
FIG. 5 is an elevated perspective view of the apparatus as in FIG. 1.
Figure 6:
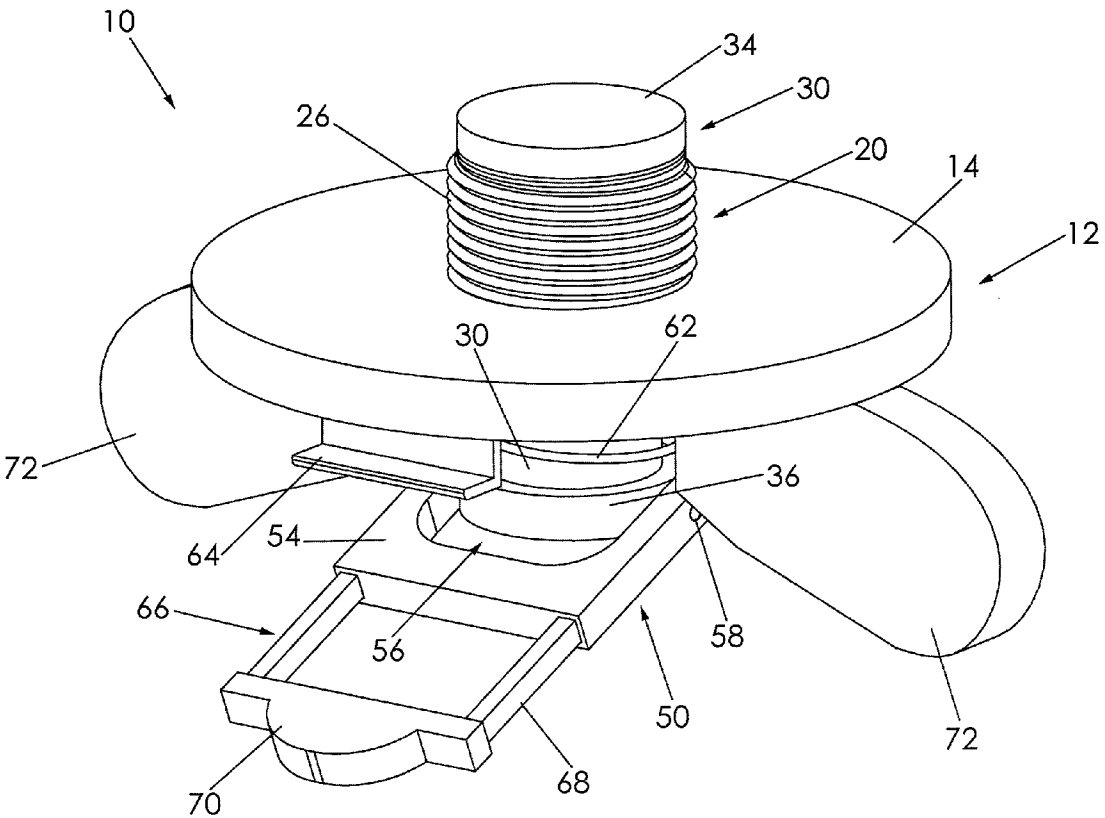
FIG. 6 is an elevated perspective view of the apparatus as in FIG. 2.
Figure 7:
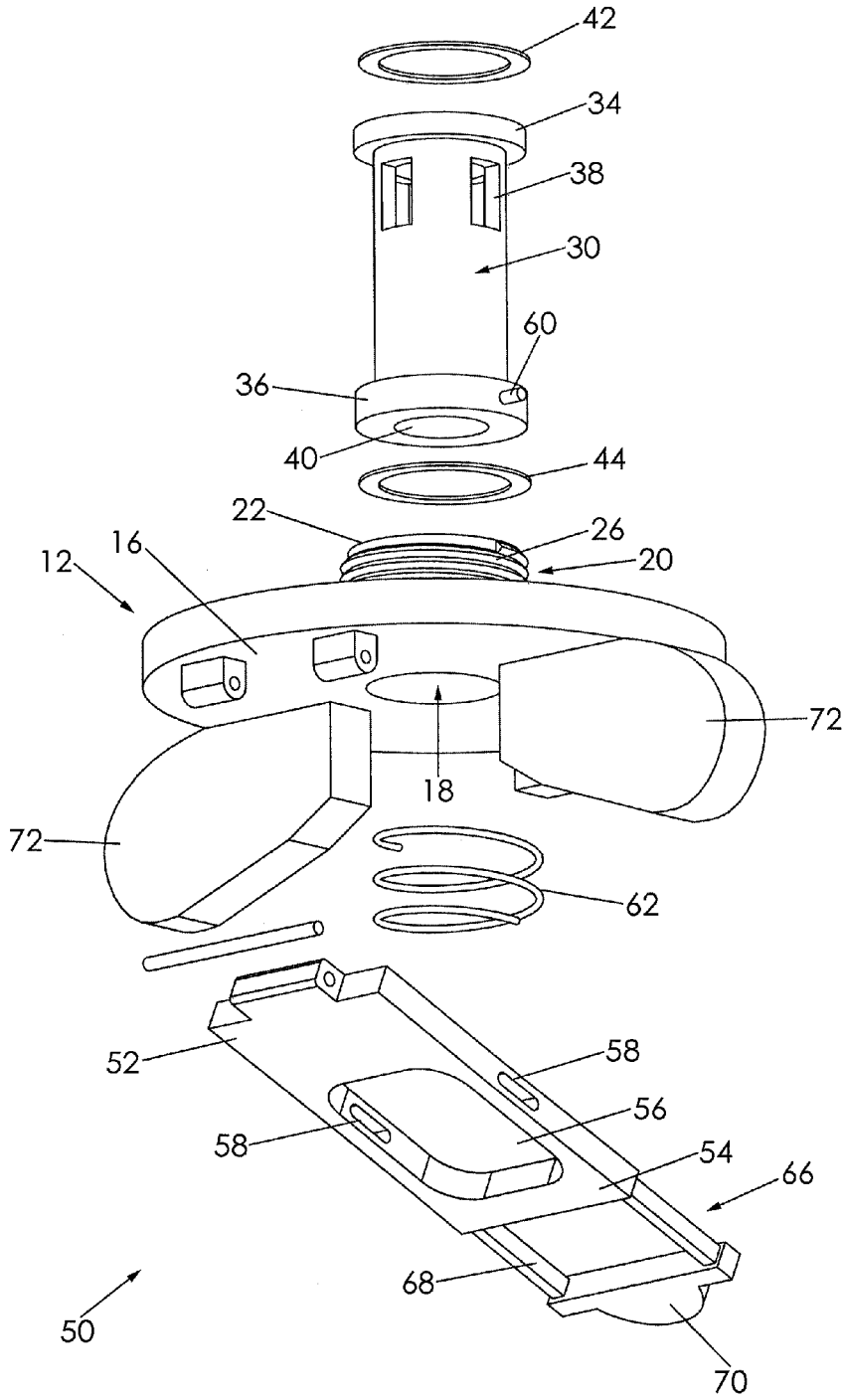
FIG. 7 is an exploded view of the apparatus according to the present invention.

A spring 62, such as a coil spring, may be situated about the inner tube 30 such as between the inner tube lower rim 36 and the base member. The spring 62 puts an outward directional tension on the lower rim 36. In other words, the lever 50 is normally at an "unactuated" configuration in which the lever 50 is urged/biased outwardly by the spring 62 and the inner tube 30 is at its retracted configuration (FIGS. 2 and 4*b*). The second end 54 of the lever 50 may be depressed by a user, such action compressing the spring 62 and pushing the inner tube 30 upwardly in the outer tube 20 toward the extended configuration. FIGS. 1 and 5 show the lever 50 in an actuated or depressed configuration in which the inner tube 30 is at its extended configuration.

A fastener 64 is mounted to the bottom surface 16 of the base member 12 (FIG. 2). The fastener 64 may be a bracket having a U-shaped configuration, a clasp, a snap, a strap, a magnet, or the like. The lever includes a handle 66 coupled to the lever second end 54 having a length adjustable portion 68. The length adjustable portion 68 may be slidably coupled to the lever second end 54 and movable between retracted and extended configurations. The distal end 70 of the length adjustable portion 68 includes a configuration complementary to a configuration of the fastener 64 so as to be captured or secured thereby when the length adjustable portion 68 is extended and the lever 50 is at the actuated configuration (FIG. 1). Further, one the fastener 64 or the distal end 70 of the handle 66 may be magnetic and the other may be metallic so as to have a magnetic attraction therebetween.

A pair of finger fasteners 72 having configurations like that of wing nuts may be mounted to the bottom surface 16 of the base member 12 (FIG. 1). The finger fasteners 72 may be opposed from one another and adjacent respective peripheral edges of the bottom surface 16. The finger fasteners 72 are configured to be gripped by a user's thumb and finger so as to rotate the base member 12, such as when the apparatus 10 is being threadably coupled to a threaded oil pan drainage port (not shown).

The oil drainage apparatus 10 may also include protective cover or cap (not shown). The cover may be coupled to the base member, such as by a snap or friction fit relationship, so as to prevent the apparatus 10 from becoming soiled or damaged during driving.

In use, the oil drainage apparatus 10 may be coupled to the oil pan drainage port of an automobile engine. Specifically, threaded exterior surface 26 of the outer tube 20 may be threadably coupled to the inner threaded surface of the drainage port. Installed in this manner, the inner tube 30 is normally in its retracted configuration nested and sealed within the channel 18 formed by the base member 12 and outer tube 20. When a user desires to drain the oil from the oil pan, the user may depress/actuate the lever 50 which moves the lever 50 to the actuated configuration (FIG. 1) and pushes the inner tube 30 to the extended configuration (FIG. 5). In the extended configuration, the apertures 38 of the inner tube 30 are above the upper ends of the outer tube 20 such that oil from the oil pan may flow into the inner area of the inner tube 30. The oil is free to flow by the force of gravity downward through the inner tube 30 and out the open bottom end 40 of the inner tube 30. The drained oil, of course, may be collected in a container for disposal.

It is understood that when the lever is depressed, the spring 62 is compressed. The length adjustable portion 68 of the handle 66 may be extended such that the distal end 70 thereof may be engaged with the fastener 64 to be held while the oil is drained as described above. When the oil is drained, the handle 66 may be released from the fastener and the lever 50 is returned to its unactuated (released) configuration by normal reflex of the compressed spring 62. It should also be appreciated that the entire apparatus may be removed from the oil pan drainage port if further cleanout of the oil pan is desired.

It is understood that while certain forms of this invention have been illustrated and described, it is not limited thereto except insofar as such limitations are included in the following claims and allowable functional equivalents thereof.

The invention claimed is:

1. An oil drainage apparatus for use with an engine having an oil pan and oil drainage port, said oil drainage apparatus, said oil drainage apparatus, comprising:

a base member having a top surface and an opposed bottom surface, said base member having an outer tube member extending outwardly from said base member top surface and defining a channel having open upper and lower ends;

wherein said outer tube member includes an exterior surface having a configuration complementary to a configuration of the oil pan drainage port so as to be removably coupled thereto;

an inner tube positioned in said channel and having a closed upper end and an open lower end, said inner tube being movable in said channel between a retracted configuration in which said inner tube closed upper end is positioned inside said channel and said outer tube and an extended configuration in which said closed upper end extends beyond said channel open upper end; and wherein said inner tube defines at least one aperture adjacent said inner tube closed upper end configured to receive oil from the oil pan into said inner tube when said inner tube is at said extended configuration and to direct the oil through said channel lower end;

a lever having one end pivotally mounted to said base member lower surface and a second end operatively coupled to said inner tube, said lever being movable between an unactuated configuration in which said inner tube is at said retracted configuration and an actuated configuration that moves said inner tube to said extended configuration;

a fastener mounted to said base member bottom surface;

wherein said lever includes a handle having a configuration complementary to a configuration of said fastener such that said handle is selectively engaged by said fastener when said lever is at said actuated configuration; and wherein said handle includes a length adjustable portion that is movable between a retracted configuration substantially adjacent said lever and an extended configuration substantially displaced from said lever, said handle being selectively engaged by said fastener when said handle is at said extended configuration.

2. The oil drainage apparatus as in claim 1, further comprising a spring situated about said inner tube such that said inner tube is normally biased to said retracted configuration.

3. The oil drainage apparatus as in claim 2, wherein:

said inner tube includes a rim generally extending outwardly from said inner tube open end that is configured to stop movement of said inner tube at said base member bottom surface when said inner tube is moving toward said extended configuration; and said spring is positioned about said inner tube between said inner tube rim and said base member bottom surface so as to normally bias said inner tube toward said retracted configuration.

4. The oil drainage apparatus as in claim 1, wherein:

said handle includes a distal end that is one of metal or a magnet;

said fastener is one of metal or magnetic such that said handle distal end is attracted to said fastener when said lever is at said actuated configuration.

5. The oil drainage apparatus as in claim 1, further comprising a pair of finger fasteners mounted to said lower surface of said base member configured to rotate said base member when said exterior surface of said outer tube member is engaged with said oil pan drainage port.

6. The oil drainage apparatus as in claim 3, wherein:

a pin extends outwardly from said rim;

said handle defines a slot having a configuration complementary to said pin and positioned such that said pin is received in said slot, said pin being movable in said slot when said handle is moved between said unactuated and said actuated configurations, said inner tube being moved to said extended configuration when said handle is moved to said actuated configuration.

7. The oil drainage apparatus as in claim 3, wherein said inner tube includes a seal situated between said rim and an outer edge of said outer tube and configured to prevent leakage of oil between said inner and outer tubes when said inner tube is at said retracted configuration.

8. An oil drainage apparatus for use with an engine having an oil pan and oil drainage port, said oil drainage apparatus, comprising:

a base member having a top surface and an opposed bottom surface forming a generally disk shaped configuration, said base member having an outer tube member extending upwardly from said base member top surface and defining a channel having open upper and lower ends extending between said base member top and bottom surfaces and said outer tube member;

wherein said outer tube member includes an exterior surface having a threaded configuration complementary to a threaded configuration of the oil pan drainage port so as to be removably coupled thereto;

an inner tube positioned in said channel and said outer tube member having a closed upper end and an open lower end, said inner tube being movable in said channel between a retracted configuration in which said inner tube closed upper end is positioned inside said channel and said outer tube member and an extended configuration in which said closed upper end extends above said channel open upper end;

wherein said inner tube defines at least one aperture adjacent said inner tube closed upper end configured to receive oil from the oil pan into said inner tube when said inner tube is at said extended configuration and to direct the oil through said channel lower end a lever having one end pivotally mounted to said base member lower surface and a second end operatively coupled to said inner tube, said lever being movable between an unactuated configuration in which said inner tube is at said retracted configuration and an actuated configuration that moves said inner tube to said extended configuration;

a fastener mounted to said base member bottom surface;

wherein said lever includes a handle having a configuration complementary to a configuration of said fastener such that said handle is selectively engaged by said fastener when said lever is at said actuated configuration;

wherein said handle includes a length adjustable portion that is movable between a retracted configuration substantially adjacent said lever and an extended configuration substantially displaced from said lever, said handle being selectively engaged by said fastener when said handle is at said extended configuration.

9. The oil drainage apparatus as in claim 8, further comprising a spring situated about said inner tube such that said inner tube is normally biased to said retracted configuration.

10. The oil drainage apparatus as in claim 9, wherein:

said inner tube includes a rim generally extending outwardly from said inner tube open end that is configured to stop movement of said inner tube at said base member bottom surface when said inner tube is moving toward said extended configuration; and said spring is positioned about said inner tube between said inner tube rim and said base member bottom surface so as to normally bias said inner tube toward said retracted configuration.

11. The oil drainage apparatus as in claim 8, wherein:

said handle includes a distal end that is one of metal or a magnet;

said fastener is one of metal or magnetic such that said handle distal end is attracted to said fastener when said lever is at said actuated configuration.

12. The oil drainage apparatus as in claim 8, further comprising a pair of finger fasteners mounted to said lower surface of said base member configured to rotate said base member when said exterior surface of said outer tube member is engaged with said oil pan drainage port.

13. The oil drainage apparatus as in claim 10, wherein:

a pin extends outwardly from said rim;

said handle defines a slot having a configuration complementary to said pin and positioned such that said pin is received in said slot, said pin being movable in said slot when said handle is moved between said unactuated and said actuated configurations, said inner tube being moved to said extended configuration when said handle is moved to said actuated configuration.

14. The oil drainage apparatus as in claim 10, wherein said inner tube includes a seal situated between said rim and an outer edge of said outer tube and configured to prevent leakage of oil between said inner and outer tubes when said inner tube is at said retracted configuration.

* * * * *